US009702020B2

(12) United States Patent
Takahashi

(10) Patent No.: US 9,702,020 B2
(45) **Date of Patent: *Jul. 11, 2017**

(54) CONTINUOUS ANNEALING FURNACE AND CONTINUOUS ANNEALING METHOD FOR STEEL STRIPS

(71) Applicant: JFE STEEL CORPORATION, Chiyoda-ku, Tokyo (JP)

(72) Inventor: Hideyuki Takahashi, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 461 days.

This patent is subject to a terminal disclaimer.

(21) Appl. No.: 14/372,649

(22) PCT Filed: Jan. 17, 2013

(86) PCT No.: PCT/JP2013/000192
§ 371 (c)(1),
(2) Date: Jul. 16, 2014

(87) PCT Pub. No.: WO2013/108624
PCT Pub. Date: Jul. 25, 2013

(65) Prior Publication Data

US 2015/0013851 A1 Jan. 15, 2015

(30) Foreign Application Priority Data

Jan. 17, 2012 (JP) ..... 2012-006994

(51) Int. Cl.
*B05D 3/02* (2006.01)
*C21D 9/56* (2006.01)
(Continued)

(52) U.S. Cl.
CPC ..... *C21D 9/561* (2013.01); *C23C 2/003* (2013.01); *C23C 2/02* (2013.01); *C23C 2/06* (2013.01);
(Continued)

(58) Field of Classification Search
CPC ..... C21D 9/56; C21D 1/767; C21D 1/26
USPC ..... 266/103
See application file for complete search history.

(56) References Cited

U.S. PATENT DOCUMENTS 9,163,305 B2 * 10/2015 Takahashi ..... C21D 1/74
9,499,875 B2 * 11/2016 Takahashi ..... C23C 2/40
(Continued)

FOREIGN PATENT DOCUMENTS

EP 2653572 10/2013
JP 59133329 7/1984
(Continued)

OTHER PUBLICATIONS

European Office Action dated Oct. 6, 2016 for European Application No. 13738991.2, 4 pages.
(Continued)

*Primary Examiner* — Scott Kastler
(74) *Attorney, Agent, or Firm* — RatnerPrestia

(57) ABSTRACT

The invention provides a vertical annealing furnace including a heating zone and a soaking zone without any partition wall therebetween. The furnace has furnace-to-refiner gas suction openings disposed in a lower portion of a joint between the soaking zone and a cooling zone and in the heating zone and/or the soaking zone except a region extending 6 m in a vertical direction and 3 m in a furnace length direction both from a steel strip inlet at a lower portion of the heating zone. The furnace has refiner-to-furnace gas ejection openings disposed in a region in the joint between the soaking zone and the cooling zone, the region being located above the pass line in the joint, and in a region in the heating zone located above 2 m below the center of upper hearth rolls in the vertical direction.

37 Claims, 4 Drawing Sheets

(51) Int. Cl.

| | |
|---|---|
| ***C23C 2/02*** | (2006.01) |
| ***C23C 2/06*** | (2006.01) |
| ***C23C 2/28*** | (2006.01) |
| ***C23C 2/40*** | (2006.01) |
| ***F27B 9/28*** | (2006.01) |
| ***C23C 2/00*** | (2006.01) |
| ***F27D 17/00*** | (2006.01) |
| *C21D 9/573* | (2006.01) |

(52) U.S. Cl.
CPC ..... *C23C 2/28* (2013.01); *C23C 2/40* (2013.01); *F27B 9/28* (2013.01); *F27D 17/004* (2013.01); *C21D 9/562* (2013.01); *C21D 9/573* (2013.01)

(56) References Cited

U.S. PATENT DOCUMENTS

| | | | | |
|---|---|---|---|---|
| 2015/0361521 | A1* | 12/2015 | Takahashi | C23C 2/40 118/65 |
| 2016/0265079 | A1* | 9/2016 | Takahashi | C21D 9/56 |

FOREIGN PATENT DOCUMENTS

| | | | |
|---|---|---|---|
| JP | 8-109417 | A | 4/1996 |
| JP | 2567130 | B2 | 12/1996 |
| JP | 2567140 | B2 | 12/1996 |
| JP | 09324209 | | 12/1997 |
| JP | 09324210 | | 12/1997 |
| JP | 2003-129125 | A | 5/2003 |
| JP | 2012126983 | A | 7/2012 |
| WO | WO 2007/043273 | A1 | 4/2007 |
| WO | WO 2012/081719 | A1 | 6/2012 |

OTHER PUBLICATIONS

Extended European Search Report mailed May 11, 2015 in European Application No. 13738991.2.

International Search Report dated Apr. 9, 2013, application No. PCT/JP2013/000192.

Japanese Office Action for Japanese Application No. 2012-006994, dated Feb. 18, 2014, including Concise Statement of Relevance of Office Action, 4 pages.

* cited by examiner

CONTINUOUS ANNEALING FURNACE AND CONTINUOUS ANNEALING METHOD FOR STEEL STRIPS

CROSS REFERENCE TO RELATED APPLICATIONS

This is the U.S. National Phase application of PCT/JP2013/000192, filed Jan. 17, 2013, which claims priority to Japanese Patent Application No. 2012-006994, filed Jan. 17, 2012, the disclosures of each of these applications being incorporated herein by reference in their entireties for all purposes.

FIELD OF THE INVENTION

The present invention relates to continuous annealing furnaces and continuous annealing methods for steel strips.

BACKGROUND OF THE INVENTION

At start-up of a continuous annealing furnace for the annealing of a steel strip which was once open to the air or in the case when the furnace allows the entry of air into the atmosphere therein, in order to decrease the concentrations of water and oxygen in the furnace, a conventional method that is widely performed is to raise the furnace temperature in order to vaporize the water in the furnace and, almost at the same time, to supply a non-oxidizing gas, for example, an inert gas as a purging gas to replace the atmosphere in the furnace while evacuating the gas in the furnace simultaneously, thereby purging the atmosphere in the furnace with the non-oxidizing gas.

However, such conventional methods require a long time to decrease the concentrations of water and oxygen in the furnace atmosphere to prescribed levels suited for steady operation. Thus, the discontinuation of operation during such a time drastically lowers productivity.

Further, in such fields as automobiles, home electric appliances and building materials, there have recently been increasing demands for high-tensile strength steel (high tensile steel) capable of contributing to enhancements such as of weight reduction of structures. In this high tensile technology, it is presented that the addition of silicon to steel possibly allows for manufacturing of high-tensile strength steel strips with good hole expandability, and further, the addition of silicon and aluminum facilitates the formation of retained γ, indicating the possibility that steel strips with good ductility may be produced.

However, high-strength cold rolled steel strips containing easily oxidizable elements such as silicon and manganese have a problem in that these easily oxidizable elements are concentrated at the surface of the steel strips during annealing to form oxides such as of silicon and manganese, deteriorating appearance or chemical conversion property such as phosphatability.

In the case of hot dip galvanized steel strips, the presence of easily oxidizable elements such as silicon and manganese in the steel strips causes a problem that these easily oxidizable elements are concentrated at the surface of the steel strips during annealing to form oxides such as of silicon and manganese, and such oxides impair coating properties to cause the occurrence of bare-spot defects or to decrease the alloying speed during an alloying treatment after the coating process. In particular, silicon is highly detrimental to coating properties and alloying treatments because a $SiO_2$ film formed on the surface of a steel strip markedly lowers the wettability of the steel strip with respect to a hot dip coating metal and also because a $SiO_2$ film serves as a barrier during an alloying treatment to inhibit the interdiffusion between the base iron and the coating metal.

A possible approach to preventing such problems is to control the oxygen potential in the annealing atmosphere.

To increase the oxygen potential, for example, Patent Literature 1 discloses a method in which the dew point in a latter half of a heating zone and in a soaking zone is controlled to a high dew point of −30° C. or above. This technique is expected to achieve effects to some degree and has an advantage that a high dew point may be controlled easily on the industrial scale. However, the technique is defective in that it does not allow for efficient production of some types of steel that do not favor being processed in a high-dew point atmosphere (for example, Ti-containing IF steel) because an annealing atmosphere once brought to a high dew point requires a very long time to become one having a low dew point. In this technique, further, the furnace atmosphere is oxidative and, unless controlled appropriately, causes a problem of pick-up defects due to the attachment of oxides to rolls in the furnace as well as a problem of damage to the furnace walls.

Lowering the oxygen potential is another possible approach. However, because such elements as silicon and manganese are highly prone to oxidation, it has been considered that there will be great difficulties in stably maintaining the atmosphere with a low dew point of −40° C. or below at which excellent suppression is possible of the oxidation of elements such as silicon and manganese, in a large continuous annealing furnace such as one disposed in a CGL (continuous hot dip galvanization line)-CAL (continuous annealing line) system.

For example, Patent Literature 2 and Patent Literature 3 disclose techniques for efficiently obtaining a low-dew point annealing atmosphere. These techniques reside in relatively small, single-pass vertical furnaces and are not designed to be applied to multi-pass vertical furnaces such as CGL and CAL systems. Thus, it is highly probable that these techniques will fail to decrease the dew point efficiently in a multi-pass vertical furnace.

In some multi-pass vertical furnaces having a heating zone and a soaking zone, the heating zone and the soaking zone are physically separated from each other by a partition wall disposed therebetween except for traveling routes for a steel strip. Other such furnaces have no partition wall between the heating zone and the soaking zone, namely, the heating zone and the soaking zone are not physically separated from each other. As compared with the case where a partition wall is present, the absence of a partition wall between the heating zone and the soaking zone allows the gas in the furnace to flow with a higher degree of freedom and with higher complexity. Thus, difficulties are frequently encountered in decreasing the dew point in the entirety of the furnace.

Patent Literature

PTL 1: International Publication No. WO 2007/043273

PTL 2: Japanese Patent No. 2567140

PTL 3: Japanese Patent No. 2567130

SUMMARY OF THE INVENTION

The present invention aims to provide a continuous annealing furnace for steel strips which can lower quickly the dew point of the furnace atmosphere to a level suited for steady operation, prior to the steady operation of continuous heat treatment of the steel strips or, when the water concentration and/or the oxygen concentration in the furnace atmosphere has increased during the steady operation.

Further, the present invention includes providing a continuous annealing furnace for steel strips which can stably create a low-dew point atmosphere having little problems in terms of the occurrence of pick-up defects and damages to furnace walls, which prevents the formation of oxides of easily oxidizable elements such as silicon and manganese in the steel that have become concentrated at the surface of steel strips during annealing, and which is hence suited for the annealing of steel strips containing easily oxidizable elements such as silicon.

Further, the invention includes providing a continuous annealing furnace to be disposed in a continuous hot dip galvanization line in which a steel strip is continuously annealed and is thereafter subjected to hot dip galvanization or, after the hot dip galvanization, further to an alloying treatment for the zing coating.

The invention also includes providing a continuous annealing method for steel strips which involves the aforementioned continuous annealing furnace.

The inventive technique is applied to continuous annealing furnaces in which a heating zone and a soaking zone in the annealing furnace are not physically separated from each other by a partition wall, and the soaking zone is in communication with a cooling zone at an upper portion of the furnace.

The present inventors have carried out studies including the measurement of dew point distribution in a large multi-pass vertical furnace and rheological analysis based on the distribution. As a result, the present inventors have found the following. Because steam ($H_2O$) has a lower specific gravity than $N_2$ gas which occupies the major proportion of the atmosphere, the dew point in a multi-pass vertical annealing furnace tends to be higher at an upper portion in the furnace. A local increase in the dew point at an upper portion of the furnace can be prevented and the dew point of the furnace atmosphere can be decreased in a short time to a prescribed level suited for steady operation by suctioning and sending the gas in the furnace through an upper part of the furnace into a refiner equipped with an oxygen removal device and a dehumidifier to lower the dew point by the removal of oxygen and water, and thereafter returning the gas having the lowered dew point into a specific section in the furnace. Further, in the above manner, the dew point of the furnace atmosphere can be stably maintained at a low level where little problems occur in terms of pick-up defects and damages to furnace walls and also at which the formation is prevented of oxides of easily oxidizable elements such as silicon and manganese in the steel that have become concentrated at the surface of steel strips during annealing.

The inventive configurations that achieve the aforementioned objects include the following aspects.

(1) A continuous annealing furnace for a steel strip including a heating zone, a soaking zone and a cooling zone disposed in this order and configured to transport the steel strip in upward and/or downward directions, a joint connecting the soaking zone and the cooling zone being disposed at an upper portion of the furnace, the heating zone and the soaking zone having no partition wall therebetween, the furnace being a vertical annealing furnace and being configured such that an atmosphere gas is supplied from outside the furnace into the furnace, the gas in the furnace is discharged through a steel strip inlet at a lower portion of the heating zone while part of the gas in the furnace is suctioned and introduced into a refiner equipped with an oxygen removal device and a dehumidifier to lower the dew point by the removal of oxygen and water in the gas, the refiner being disposed outside the furnace, and the gas with the lowered dew point is returned into the furnace, the furnace having furnace-to-refiner gas suction openings disposed in a lower portion of the joint between the soaking zone and the cooling zone and at least one of in the heating zone and the soaking zone, the heating zone being free from any gas suction openings in a region extending 6 m in a vertical direction and 3 m in a furnace length direction both from the steel strip inlet at a lower portion of the heating zone, the furnace having refiner-to-furnace gas ejection openings disposed in a region in the joint between the soaking zone and the cooling zone, the region being located above the pass line in the joint, and in a region in the heating zone, the region being located above a position 2 m below the center of upper hearth rolls in the vertical direction.

(2) The continuous annealing furnace for a steel strip described in (1), wherein the refiner-to-furnace gas ejection openings disposed in the region above a position 2 m below the center of upper hearth rolls in the heating zone in the vertical direction have an ejection width W0 satisfying W0/W>¼ wherein W is the furnace width of the heating zone plus the soaking zone.

Here, the ejection width W0 of the gas ejection openings is defined as the distance in the furnace length direction between the most upstream gas ejection opening and the most downstream gas ejection opening in the heating zone.

(3) The continuous annealing furnace for a steel strip described in (1) or (2), wherein the furnace-to-refiner gas suction opening disposed in the lower portion of the joint between the soaking zone and the cooling zone is disposed in a choked gas flow channel in the lower portion of the joint between the soaking zone and the cooling zone.

(4) The continuous annealing furnace for a steel strip described in any of (1) to (3), wherein the furnace-to-refiner gas suction openings are disposed in a plurality of positions in the heating zone and/or the soaking zone, and the furnace has dew point detection units of dew point meters disposed in the vicinity of the gas suction openings in the plurality of positions, the dew point detection units being configured to detect the dew points of the gas in the furnace.

(5) The continuous annealing furnace for a steel strip described in any of (1) to (4), wherein the cooling zone is configured to transport the steel strip therethrough in a single pass.

(6) The continuous annealing furnace for a steel strip described in any of (1) to (5), wherein the furnace includes a hot dip galvanization facility downstream the annealing furnace.

(7) The continuous annealing furnace for a steel strip described in (6), wherein the hot dip galvanization facility includes a galvannealing apparatus.

(8) A continuous annealing method for a steel strip, characterized by continuously annealing a steel strip with the continuous annealing furnace for a steel strip described in any of (4) to (7) in such a manner that the dew point of a gas in the furnace is measured with the dew point meters disposed at the heating zone and/or the soaking zone, and the gas in the furnace is suctioned preferentially through the gas suction opening disposed in a position where a higher value of dew point has been measured.

Prior to the steady operation of continuous heat treatment of a steel strip or when the water concentration and/or the oxygen concentration in the furnace atmosphere has increased during the steady operation, the continuous annealing furnace for steel strips according to the present invention can shorten a period of time that the water concentration and/or the oxygen concentration in the furnace atmosphere is reduced to such a level where the dew point of the furnace atmosphere is lowered to −30° C. or below, permitting stable production of steel strips. Thus, the inventive furnace preferably prevents a decrease in productivity.

Further, the inventive furnace for continuous annealing of steel strips allows the furnace atmosphere to stably maintain a low dew point of −40° C. or below where little problems occur in terms of pick-up defects and damages to furnace walls and also at which the formation is prevented of oxides of easily oxidizable elements such as silicon and manganese in the steel that have become concentrated at the surface of steel strips during annealing. Further, the inventive furnace for continuous annealing of steel strips allows for easy manufacturing of steels such as Ti-containing IF steel which do not favor operation in a high-dew point atmosphere.

DETAILED DESCRIPTION OF EMBODIMENTS OF THE INVENTION

Figure 1:
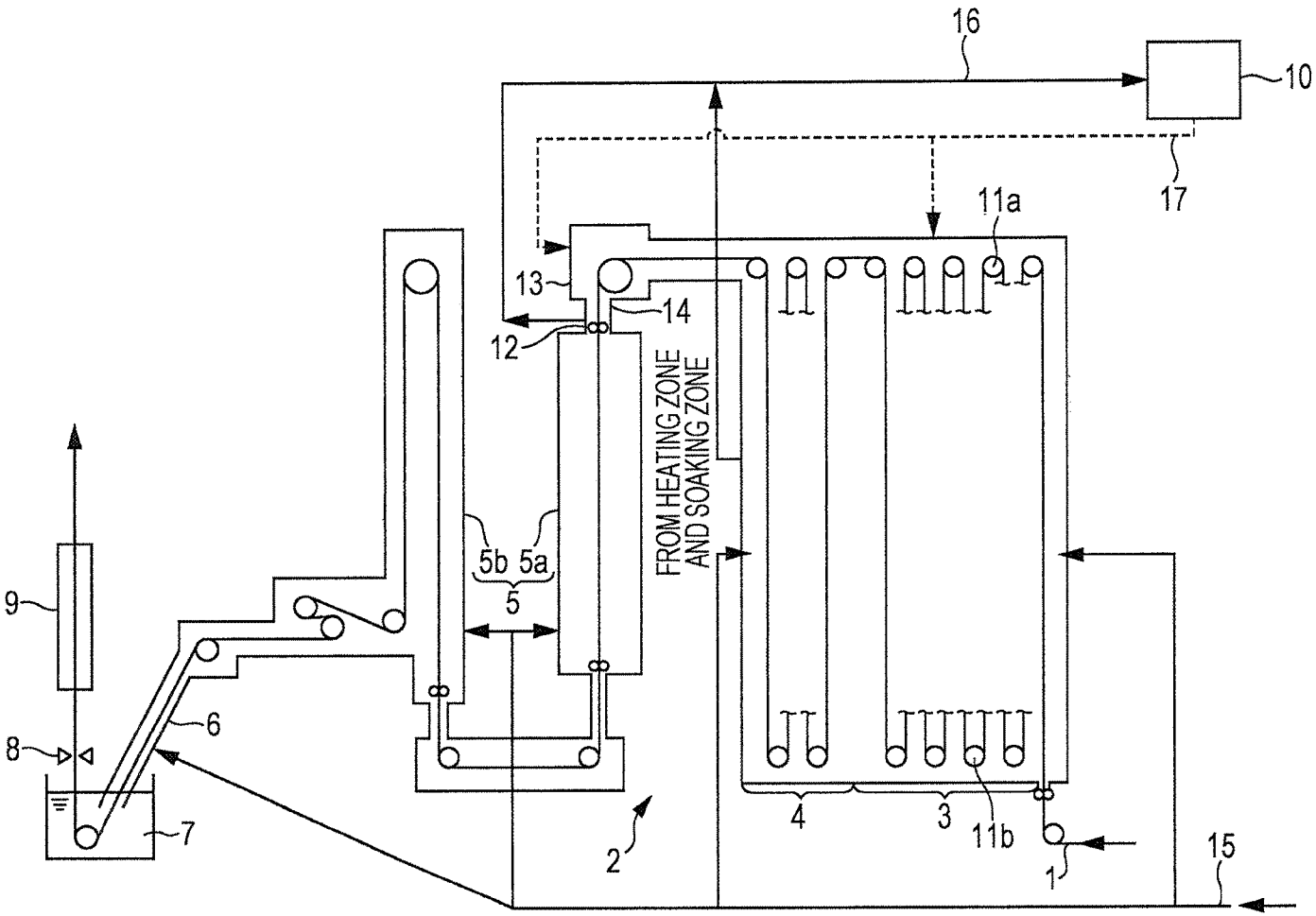
FIG. 1 is a view illustrating an exemplary configuration of a continuous hot dip galvanization line including a continuous annealing furnace for steel strips according to an embodiment of the invention.

A continuous hot dip galvanization line for steel strips includes an annealing furnace upstream to a coating bath. Usually, the annealing furnace includes a heating zone, a soaking zone and a cooling zone disposed in this order from the upstream to the downstream of the furnace. A preheating zone may be sometimes disposed upstream to the heating zone. The annealing furnace is connected to the coating bath via a snout. The inside of the furnace extending from the heating zone to the snout is maintained in a reducing atmosphere gas or in a non-oxidizing atmosphere. The heating zone and the soaking zone involve radiant tubes (RT) as heating units to indirectly heat the steel strip. The reducing atmosphere gas is usually $H_2$—$N_2$ gas and is introduced into appropriate positions inside the furnace between the heating zone and the snout. On the line, the steel strip is heated and annealed at prescribed temperatures in the heating zone and the soaking zone, then cooled in the cooling zone, then transported through the snout into the coating bath in which the steel strip is hot dip galvanized, and optionally further subjected to galvannealing.

Because the furnace in the continuous hot dip galvanization line (CGL) is connected to the coating bath via the snout, the gas introduced into the furnace is discharged through the entrance of the furnace except for unavoidable gas escape such as leakage from the furnace body. That is, the gas in the furnace flows from the downstream to the upstream of the furnace reverse to the direction in which the steel strip is moved. Because steam ($H_2O$) has a lower specific gravity than $N_2$ gas which occupies the major proportion of the atmosphere, the dew point in a multi-pass vertical annealing furnace tends to be higher at an upper portion in the furnace.

To efficiently decrease the dew point, it is important that the atmosphere gas in the furnace do not stagnate (the atmosphere gas do not stagnate at an upper portion, a middle portion and a lower portion in the furnace) so that the dew point will not increase in the upper portion of the furnace. It is also important to know sources of water that increases the dew point. Possible sources of water ($H_2O$) are furnace walls, steel strips, entry of outside air through the furnace entrance, and entry of water from the cooling zone and the snout. Leaks in radiant tubes and in furnace walls can possibly serve as water supply sources.

The dew point exerts larger influences on coating properties with increasing temperature of the steel strip. The influences become particularly marked when the steel strip temperature is in the range of 700° C. and above in which the steel strip shows higher reactivity with oxygen. Accordingly, the dew point in the latter half of the heating zone and in the soaking zone where the steel strip has an elevated temperature will significantly affect coating properties. In the case where there are no physical division (such as a partition wall) between the heating zone and the soaking zone, the atmosphere is continuous from the heating zone to the soaking zone and this fact requires that the dew point be efficiently reduced in the entire region of the furnace including the heating zone and the soaking zone.

Specifically, it is advantageous to be able to shorten, prior to the steady operation of continuous heat treatment of a steel strip or when the water concentration and/or the oxygen concentration in the furnace atmosphere has increased during the steady operation, a period of time that the water concentration and/or the oxygen concentration in the furnace atmosphere be lowered to such a level where the dew point of the entire furnace atmosphere is lowered to −30° C. or below at which stable production of steel strips is feasible.

It is also advantageous that the dew point be lowered to −40° C. or below at which excellent suppression is possible of the oxidation of elements such as silicon and manganese. Ideally, dew point reduction is appropriately performed only in a region where the steel strip has a high temperature. However, as mentioned above, a furnace having a heating zone and a soaking zone which are not separated from each other causes a difficulty in lowering the dew point locally in the heating zone Or the soaking zone. Thus, dew point reduction should be carried out in the entirety of the heating zone and the soaking zone. A lower dew point is more advantageous in terms of coating properties. Thus, it is preferable to be able to decrease the dew point to −45° C. or below, and more preferably to −50° C. or below.

According to an embodiment of the invention, the dew point of the atmosphere gas is decreased by introducing part of the atmosphere gas in the furnace to a refiner disposed outside the furnace which has an oxygen removal device and a dehumidifier to lower the dew point by the removal of oxygen and water in the gas, and thereafter returning the gas having the lowered dew point into the furnace. This process involves the following arrangements 1) to 3) of gas suction openings through which the gas in the furnace is introduced into the refiner, and gas ejection openings through which the gas having the lowered dew point is returned from the refiner into the furnace.

1) A high-dew point gas from the coating pot side finds its way to an upper portion of the cooling zone. Further, the entry of outside air through the cooling zone and the snout has to be prevented. From these viewpoints, the stagnation of the atmosphere gas at this region should be prevented. Thus, a gas suction opening for the introduction to the refiner is disposed in this region. While this suction of the gas may prevent the occurrence of gas stagnation in this region, the suctioning can possibly decrease the furnace pressure in the vicinity of this region to a negative pressure. Thus, a gas ejection opening is disposed in a joint between the soaking zone and the cooling zone, and the gas returning from the refiner is ejected therethrough. To make sure that there will be no stagnation of the gas, the gas ejection opening is desirably disposed in the furnace wall above the pass line in the soaking zone-cooling zone joint while the gas suction opening is desirably disposed in a throat section that is a lower part of the joint between the soaking zone and the cooling zone or in a choked portion of the gas flow channel such as near seal rolls. The gas suction opening is preferably located within 4 m, and more preferably within 2 m from a cooling device (a cooling nozzle) in the cooling zone, because the gas suction opening excessively remote from the cooling device causes the steel sheet to be exposed to the high-dew point gas for a long time before the start of cooling, thus causing a risk that elements such as silicon and manganese can be concentrated at the surface of the steel sheet. Further, the gas suction opening and the gas ejection opening are desirably disposed at least 2 m away from each other. If the suction opening and the ejection opening are too close to each other, the gas that is suctioned through the suction opening will contain a small proportion of high-dew point gas (the low-dew point gas returned from the refiner will represent a large proportion of the gas suctioned), resulting in a decrease in the efficiency of furnace dehumidification.

2) Ideally, a furnace gas suction opening in a heating zone and a soaking zone is disposed in a location where the dew point becomes highest. In the case, however, where the heating zone and the soaking zone are not physically separated by a partition wall, the location where the dew point becomes highest in the soaking zone is not fixed to a specific region but changes in accordance with, for example, operation conditions. Thus, it is preferable that gas suction openings be disposed in a plurality of positions in the heating zone and the soaking zone so that the gas in the furnace can be suctioned through any of the above mentioned plurality of positions. It is also desirable that the dew point of the gas in the furnace be measured in the vicinity of the plurality of suction openings and the gas in the furnace be preferentially suctioned selectively through the suction opening disposed in the location where a higher dew point has been measured. The gas suction openings are disposed in the furnace except a region extending 6 m in the vertical direction and 3 m in the furnace length direction both from a steel strip inlet at a lower portion of the heating zone. This is because, if the gas suction openings are disposed within 6 m in the vertical direction and within 3 m in the furnace length direction from the steel strip inlet at a lower portion of the heating zone, the probability is increased for an exterior gas to be drawn into the furnace to possibly increase the dew point.

3) An upper portion of the heating zone is substantially free from the flow of the furnace gas and the atmosphere gas stagnates there easily due to its structure. Accordingly, the dew point in this region tends to be high. Thus, openings are disposed in the upper portion of the heating zone to eject therethrough the gas that has returned from the refiner. To control stagnation, the gas ejection openings are advantageously disposed at as high a position as possible in the heating zone. It is therefore preferred that the gas ejection openings be disposed at least in a region located above a position 2 m below the center of upper hearth rolls in the heating zone in the vertical direction (in a region above the −2 m level in the vertical direction).

If the gas ejection openings disposed in the upper portion of the heating zone have an excessively small value of ejection width W0, the effectiveness in preventing the gas stagnation at the upper portion of the heating zone is lowered. Thus, the ejection width W0 of the gas ejection openings in the upper portion of the heating zone preferably satisfies $W0/W>1/4$ wherein W is the furnace width of the heating zone plus the soaking zone (the total furnace width). Here, the ejection width W0 of the gas ejection openings in the heating zone is the distance in the furnace length direction between the most upstream gas ejection opening and the most downstream gas ejection opening in the heating zone (see FIG. 2).

The present invention is based on the above viewpoints.

Hereinbelow, embodiments of the invention will be described with reference to FIG. 1 to FIG. 3.

FIG. 1 illustrates an exemplary configuration of a continuous hot dip galvanization line for a steel strip which includes a vertical annealing furnace used for the implementation of the present invention.

In FIG. 1, reference sign 1 denotes a steel strip. An annealing furnace 2 includes a heating zone 3, a soaking zone 4 and a cooling zone 5 disposed in this order in the direction of the travel of the steel strip. In the heating zone 3 and the soaking zone 4, a plurality of upper hearth rolls 11*a* and lower hearth rolls 11*b* are disposed so as to constitute multiple passes in which the steel strip 1 is transported a plurality of times in upward and downward directions. Radiant tubes are used as heating units to indirectly heat the steel strip 1. Also illustrated are a snout 6, a coating bath 7, gas wiping nozzles 8, a galvannealing heating device 9, and a refiner 10 which deoxidizes and dehumidifies the atmosphere gas suctioned from the inside of the furnace.

A joint 13 between the soaking zone 4 and the cooling zone 5 is disposed in an upper portion of the furnace above the cooling zone 5. In the joint 13, a roll is disposed which guides the steel strip 1 delivered from the soaking zone 4 to travel in a downward direction. In order to prevent the atmosphere in the soaking zone 4 from entering the cooling zone 5 and to prevent the entry of radiation heat from the furnace walls of the joint into the cooling zone 5, the exit at a lower portion of the joint that continues to the cooling zone 5 defines a throat section (a throat-like structure having a smaller sectional area of the steel strip channel) and seal rolls 12 are disposed in the throat section 14.

The cooling zone 5 is composed of a first cooling zone 5*a* and a second cooling zone 5*b*. The first cooling zone 5*a* has a single pass for the steel strip.

Reference sign 15 denotes an atmosphere gas supply system 15, through which an atmosphere gas is supplied from the outside to the inside of the furnace and the atmosphere gas is fed into the refiner 10 through a gas introduction pipe 16 and out of the refiner 10 through a gas delivery pipe 17.

The feed rates and the supply of the atmosphere gas into the heating zone 3, the soaking zone 4, the cooling zone 5 and subsequent zones in the furnace may be individually adjusted or terminated with use of valves (not shown) and flow meters (not shown) disposed in the course of the atmosphere gas supply system 15 to the respective zones. In order to chemically reduce oxides present on the surface of the steel strip and to save the cost of the atmosphere gas, a usual atmosphere gas supplied into the furnace has a composition including 1 to 10 vol % $H_2$ and the balance of $N_2$ and inevitable impurities. The dew point of such an atmosphere gas is about −60° C.

Figure 2:
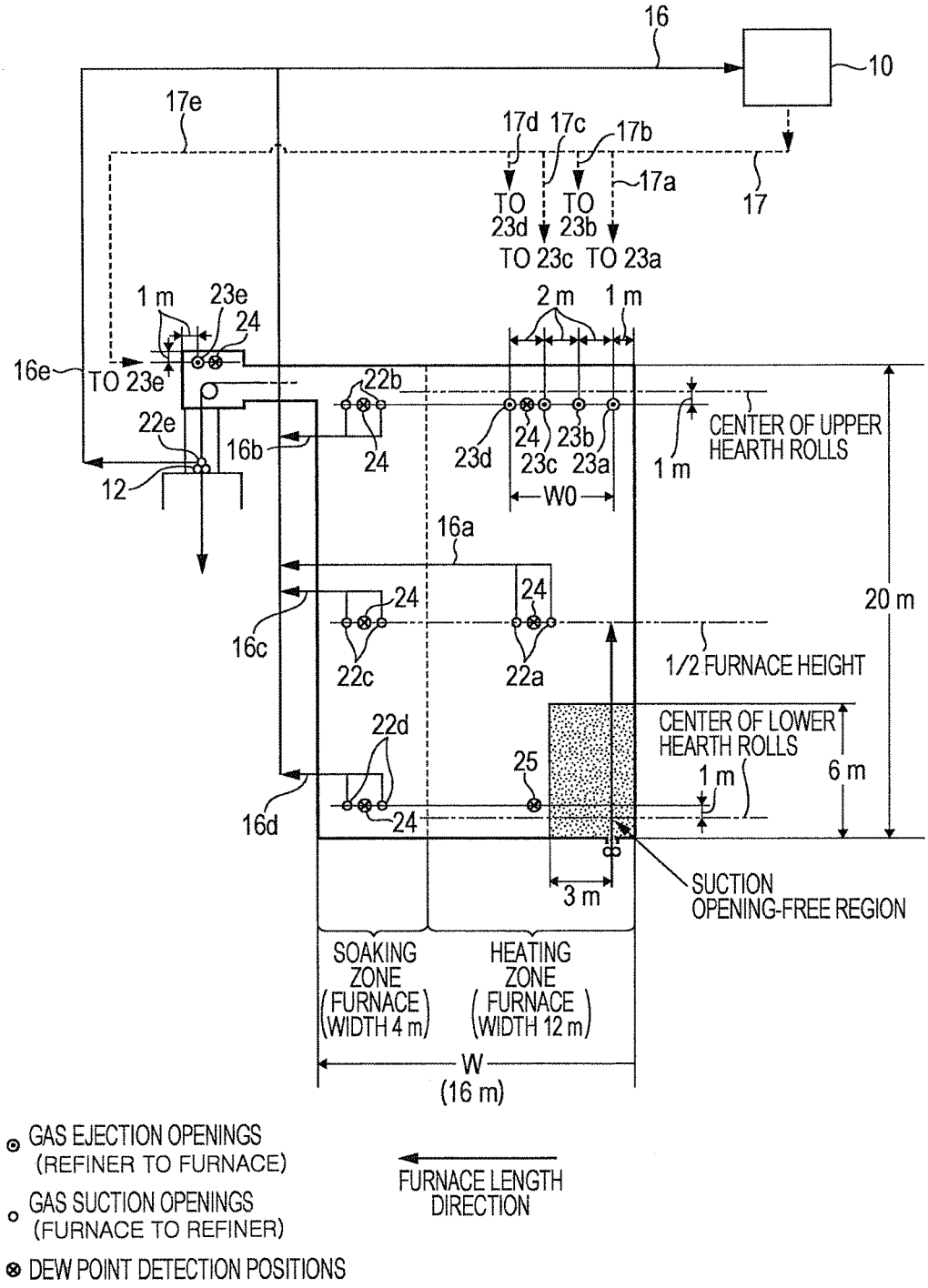
FIG. 2 is a view illustrating an example of arrangement of furnace-to-refiner gas suction openings and refiner-to-furnace gas ejection openings.

Gas suction openings to introduce the furnace gas into the refiner are disposed in a choked gas flow channel in a lower portion of the joint 13 between the soaking zone 4 and the cooling zone 5, for example, the throat section 14, and also in the heating zone 3 and/or the soaking zone 4 except a region extending 6 m in the vertical direction and 3 m in the furnace length direction both from a steel strip inlet at a lower portion of the heating zone 3 (see FIG. 2). Preferably, the suction openings are disposed in a plurality of positions in the heating zone 3 and/or the soaking zone 4. When seal rolls are disposed in the throat section 14, the width of gas flow channel is even narrower in that location and therefore the placement of the gas suction opening at or in the vicinity of the location is more desirable.

Gas ejection openings to return a gas whose dew point has been decreased in the refiner back into the furnace are disposed in the joint 13 between the soaking zone 4 and the cooling zone 5 and also in the heating zone 3. The gas ejection opening in the joint 13 between the soaking zone 4 and the cooling zone 5 is disposed above the pass line. The gas ejection opening in the heating zone 3 is disposed in a region located above a position 2 m below the center of the upper hearth rolls in the heating zone 3 in the vertical direction. Preferably, the gas ejection openings are disposed in a plurality of positions in the heating zone.

FIG. 2 illustrates an example of arrangement of the gas suction openings and the gas ejection openings for the delivery of the gas into and out of the refiner 10. Reference signs 22*a* to 22*e* denote furnace-to-refiner gas suction openings. Reference signs 23*a* to 23*e* denote refiner-to-furnace gas ejection openings. Reference sign 24 denotes a dew point detection unit. The furnace width of the heating zone is 12 m, the furnace width of the soaking zone is 4 m, and the furnace width of the heating zone plus the soaking zone is 16 m.

The furnace-to-refiner gas suction openings have a diameter of 200 mm. A single opening (22*e*) is disposed in the throat section that is a lower portion of the joint 13 between the soaking zone 4 and the cooling zone 5. Further, a total of four pairs (22*a* to 22*d*) that are each a pair of two suction openings 1 m away from each other in the furnace length direction are disposed, one at 1 m below the center of the upper hearth rolls in the soaking zone, one at ½ of the furnace height in the soaking zone (at the center in the height direction), one at 1 m above the center of the lower hearth rolls in the soaking zone, and one in the center of the heating zone (at ½ of the furnace height and in the middle in the furnace length direction).

The refiner-to-furnace gas ejection openings have a diameter of 50 mm. One (23*e*) is disposed in an exit-side furnace wall of the joint between the soaking zone and the cooling zone, specifically, at 1 m above the pass line and 1 m below the ceiling wall. Other four (23*a* to 23*d*) are disposed 1 m below the center of the upper hearth rolls in the heating zone with intervals of 2 m in the furnace length direction, starting from the position in the heating zone that is 1 m away from the entrance-side furnace wall.

The dew point detection units 24 of dew point meters are configured to detect the dew points of the gas in the furnace. The units are disposed in the joint between the soaking zone and the cooling zone, in the middle between the respective two suction openings disposed in the soaking zone and the heating zone, and in the middle between the third and fourth ejection openings in the heating zone counted from the entrance-side furnace wall (in the middle between the ejection openings 23*c* and 23*d*).

The atmosphere gas suction openings are disposed in a plurality of positions in the heating zone and the soaking zone for the following reasons.

Regardless of the presence or absence of a partition wall between the heating zone and the soaking zone, the distribution of dew point in the furnace varies significantly depending on the status in the furnace (for example, the degree of breakage of the radiant tubes and the seals in the furnace body). It is however the case that the presence of a partition wall limits the flow of gas in the furnace to make it easy to determine where the refiner-to-furnace gas ejection opening and the furnace-to-refiner gas suction opening should be disposed in order to efficiently decrease the dew point. In the absence of a partition wall, on the other hand, the flow of gas in the furnace becomes complicated and the locations of the suction opening and the ejection opening connected to or from the refiner need to be changed in accordance with the status of the dew point. In particular, the suction opening needs to be disposed in a position where the atmosphere has a higher dew point because otherwise the furnace cannot be dehumidified efficiently, resulting in a failure to obtain the desired dew point or a need for increasing the size of the furnace facility. By providing the gas suction openings in a plurality of positions, the gas can be efficiently suctioned from the position where the dew point is high. Thus, the dew point may be decreased to the desired level without involving a large furnace facility.

The atmosphere gas suctioned through the gas suction opening may be introduced into the refiner through any of furnace-to-refiner gas introduction pipes 16*a* to 16*e* and through a furnace-to-refiner gas introduction pipe 16. The amounts of the suction of the furnace atmosphere gas through the suction openings may be individually controlled by adjusting or terminating with use of valves (not shown) and flow meters (not shown) disposed in the course of the gas introduction pipes 16*a* to 16*e*.

The gas that has been deoxidized and dehumidified in the refiner to a reduced dew point may be ejected into the furnace through any of the ejection openings 23*a* to 23*e* via a refiner-to-furnace gas delivery pipe 17 and any of refiner-to-furnace gas delivery pipes 17*a* to 17*e*. The amounts of the ejection of the gas into the furnace through the ejection openings may be individually controlled by adjusting or terminating with use of valves (not shown) and flow meters (not shown) disposed in the course of the gas delivery pipes 17*a* to 17*e*.

Figure 3:
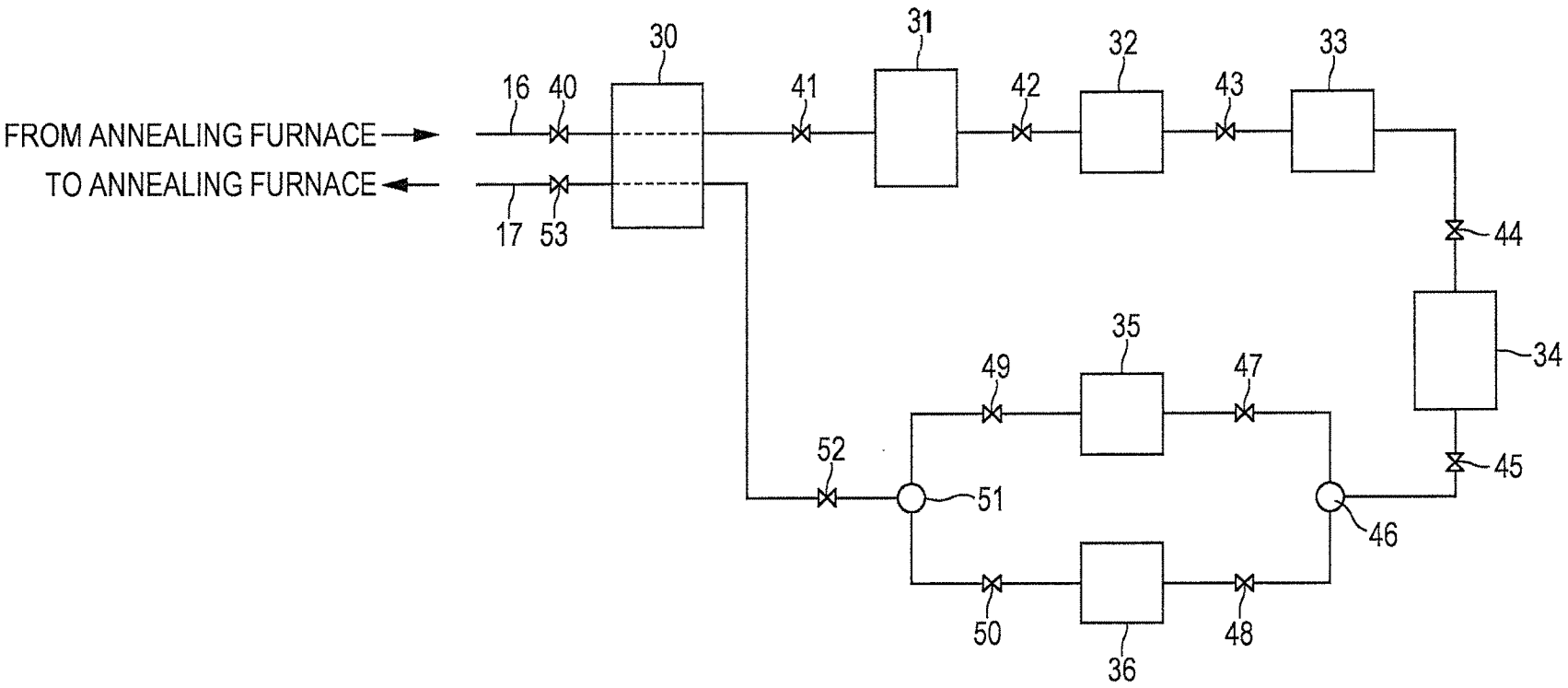
FIG. 3 is a view illustrating an exemplary configuration of a refiner.

FIG. 3 shows an exemplary configuration of the refiner 10. FIG. 3 illustrates a heat exchanger 30, a cooler 31, a filter 32, a blower 33, an oxygen removal device 34, dehumidifiers 35 and 36, selector valves 46 and 51, and valves 40 to 45, 47 to 50, 52 and 53. The oxygen removal device 34 utilizes a palladium catalyst. The dehumidifiers 35 and 36 employ a synthetic zeolite catalyst. The two dehumidifiers 35 and 36 are arranged in parallel to allow for continuous operation.

In a process of annealing and galvanizing the steel strip 1 in the above continuous hot dip galvanization line, the steel strip is annealed by being heated to a prescribed temperature (for example, about 800° C.) while it is transported through the heating zone 3 and the soaking zone 4, and is thereafter cooled to a prescribed temperature in the cooling zone 5. After the cooling, the steel strip is hot dip galvanized by being soaked into the coating bath 7 through the snout 6. After the steel strip is lifted from the coating bath, the coating amount is adjusted to a desired amount with the gas wiping nozzles 8 disposed above the coating bath. After the coating amount is adjusted, the steel strip is galvannealed as required with the heating device 9 disposed above the gas wiping nozzles 8.

During the above process, an atmosphere gas is supplied into the furnace through the atmosphere gas supply system 15. The type, the composition and the method for the supply of the atmosphere gas may be conventional. Usually, $H_2$—$N_2$ gas is used for an atmosphere gas, and the gas is supplied into the heating zone 3, the soaking zone 4, the cooling zone 5 and subsequent zones in the furnace.

By the operation of the blower 33, the atmosphere gas is suctioned from the heating zone 3, the soaking zone 4, and the throat section 14 that is a lower portion of the joint 13 between the soaking zone 4 and the cooling zone 5 through the furnace-to-refiner gas suction openings 22*a* to 22*e*. The atmosphere gas that has been suctioned is sequentially passed through the heat exchanger 30 and the cooler 31 and thereby the atmosphere gas is cooled to about 40° C. or less. The atmosphere gas is then cleaned through the filter 32, deoxidized with the oxygen removal device 34, and dehumidified with the dehumidifier 35 or 36, thereby decreasing the dew point to about −60° C. Switching between the dehumidifiers 35 and 36 may be performed by operating the selector valves 46 and 51.

The gas whose dew point has been decreased is passed through the heat exchanger 30 and is then returned to the heating zone 3 and to the joint 13 between the soaking zone 4 and the cooling zone 5 through the refiner-to-furnace gas ejection openings 23*a* to 23*e*. The gas having the lowered dew point passes through the heat exchanger 30, and thereby the temperature of the gas to be ejected into the furnace can be increased.

The gas in the furnace is continuously suctioned through the gas suction opening 22*e* in the throat section 14 that is a lower portion of the joint 13 between the soaking zone 4 and the cooling zone 5. The furnace gas may be suctioned through all of the gas suction openings 22*a* to 22*d* disposed in the heating zone 3 and the soaking zone 4 simultaneously, or may be suctioned through any gas suction openings in two or more positions, or may be preferentially suctioned through any one gas suction opening disposed in a high-dew point region that is selected based on the dew point data obtained with the dew point meters.

It is not indispensable to eject the gas to the joint 13 between the soaking zone 4 and the cooling zone 5 (the gas ejection through the ejection opening 23*e*). The gas ejection to the heating zone 3 is indispensable. The gas may be ejected through any one or more of the refiner-to-furnace gas ejection openings 23*a* to 23*d*. When the gas is ejected through plural openings, the ejection width W0 of the gas ejection openings preferably satisfies W0/W>¼ wherein W is the furnace width of the heating zone plus the soaking zone.

By virtue of the aforementioned arrangement of the furnace-to-refiner gas suction openings and the refiner-to-furnace gas ejection openings, and also by appropriate control of the amounts in which the gas is suctioned or ejected through the respective suction openings or the respective ejection openings, the atmosphere gas is prevented from stagnating in the upper portion, the middle portion and the lower portion of the furnace in the soaking zone and the former half of the cooling zone and consequently the increase in dew point at the upper portion of the furnace can be prevented.

It is, of course, the case that a higher rate of gas supply into the refiner is more advantageous in order to decrease the dew point. However, a high flow rate requires wider pipe diameters and larger dehumidification and deoxidation facilities, incurring an increase in facility costs. It is therefore important that the target dew point be achieved with a minimum flow rate of the gas introduced into the refiner. The aforementioned arrangement of the furnace-to-refiner gas suction openings and the refiner-to-furnace gas ejection openings makes it possible to decrease the flow rate of the gas into the refiner required to obtain the desired dew point.

As a result, it becomes possible to reduce the time required, prior to the steady operation of continuous heat treatment of a steel strip or when the water concentration and/or the oxygen concentration in the furnace atmosphere has increased during the steady operation, to decrease the water concentration and/or the oxygen concentration in the furnace atmosphere to such a level where the dew point of the furnace atmosphere is lowered to −30° C. or below at which stable production of steel strips is feasible. In this manner, a decrease in productivity may be prevented. Further, it is possible to reduce the dew point of the atmosphere in the soaking zone and the joint between the soaking zone and the cooling zone to −40° C. or below, or further to −45° C. or below. Furthermore, the atmosphere gas can be prevented from stagnating in the upper portion, the middle portion and the lower portion of the furnace in the latter half of the heating zone, and the dew point of the atmosphere in the latter half of the heating zone, the soaking zone and the joint between the soaking zone and the cooling zone can be decreased to −45° C. or below, or further to −50° C. or below.

The dew point of the gas in the furnace is measured with dew point meters disposed in a plurality of positions, and the gas in the furnace is suctioned preferentially through the suction opening disposed in a position where a higher dew point has been measured. In this manner, the furnace-to-refiner gas flow rate required to obtain the desired dew point may be decreased.

Although any preheating furnace is not disposed upstream the heating zone in the CGL described above, the line may include a preheating furnace.

While the above embodiments of the invention illustrate CGL, the invention may be applied to a continuous annealing line (CAL) in which a steel strip is continuously annealed.

According to the functions described hereinabove, it becomes possible to reduce the time required, prior to the steady operation of continuous heat treatment of a steel strip or when the water concentration and/or the oxygen concentration in the furnace atmosphere has increased during the steady operation, to decrease the water concentration and/or the oxygen concentration in the furnace atmosphere to such a level where the dew point of the furnace atmosphere is lowered to −30° C. or below permitting stable production of steel strips. That is, a decrease in productivity may be prevented. Further, the inventive configurations allow the furnace atmosphere to stably maintain a low dew point of −40° C. or below where little problems occur in terms of pick-up defects and damages to furnace walls and also at which excellent suppression is possible of the formation of oxides of easily oxidizable elements such as silicon and manganese in the steel that have become concentrated at the surface of steel strips during annealing. As a result, easy manufacturing becomes possible of steels such as Ti-containing IF steel which do not favor operation in a high-dew point atmosphere.

EXAMPLE 1

A dew point measurement test was carried out in an ART type (all radiant type) CGL illustrated in FIG. 1 (annealing furnace length: 400 m, furnace height in heating zone and soaking zone: 23 m, furnace width in heating zone: 12 m, furnace width in soaking zone: 4 m).

The furnace had openings through which the atmosphere gas from outside of the furnace is supplied at a total of six locations in the soaking zone, namely, at three locations arranged in the furnace length direction both at 1 m and 10 m above the hearth bottom on the drive side, and at a total of sixteen locations in the heating zone, namely, at eight locations arranged in the furnace length direction both at 1 m and 10 m above the hearth on the drive side. The dew point of the atmosphere gas to be supplied was −60° C.

Furnace-to-refiner gas suction openings and refiner-to-furnace gas ejection openings were disposed as illustrated in FIG. 2. Specifically, the gas suction openings were disposed in a throat section that was a lower portion of the joint between the soaking zone and the cooling zone, and further at 1 m below the center of upper hearth rolls in the soaking zone, in the center of the soaking zone (at the center of the furnace height and in the middle in the furnace length direction), at 1 m above the center of lower hearth rolls in the soaking zone, and in the center of the heating zone (at the center of the furnace height and in the middle in the furnace length direction), thereby allowing the gas to be suctioned through any of these positions in the heating zone and the soaking zone selected based on the dew point data. The refiner-to-furnace gas ejection openings were disposed at a position 1 m away from each of an exit-side furnace wall and a ceiling wall of the joint between the soaking zone and the cooling zone, and at four positions which were 1 m below the center of the upper hearth rolls in the heating zone and were arranged with intervals of 2 m starting from 1 m away from an entrance-side furnace wall. The suction openings had a diameter of 200 mm and were paired with a distance therebetween of 1 m except at the joint. A single suction opening was disposed in the joint. The diameter of the ejection openings was 50 mm, and a single ejection opening was disposed in the joint and the other four were disposed in the upper portion of the heating zone with intervals of 2 m. The distance was 4 m between the ejection opening disposed in the joint between the soaking zone and the cooling zone, and the suction opening disposed in the throat section that was a lower portion of the joint.

The refiner included dehumidifiers with a synthetic zeolite, and an oxygen removal device with a palladium catalyst.

Steel strips having a sheet thickness of 0.8 to 1.2 mm and a sheet width of 950 to 1000 mm were tested under as uniform conditions as possible at an annealing temperature of 800° C. and a line speed of 100 to 120 mpm. The alloy components in the steel strips are described in Table 1.

While supplying $H_2$—$N_2$ gas ($H_2$ concentration 10 vol %, dew point −60° C.) as an atmosphere gas, the dew point of the atmosphere without operation of the refiner (the initial dew point) was obtained as the base value (−34° C. to −36° C.) and the dew point after 1-hour operation of the refiner was studied. The dew point was measured in the centers of the furnace widths of the heating zone and the soaking zone, at the same height as the gas suction openings or the gas ejection openings. To measure the dew point in a lower portion of the heating zone, an additional dew point detection unit (a dew point detection unit 25 in FIG. 2) was disposed in the center of the heating zone in the furnace length direction and 1 m above the center of the lower hearth rolls.

TABLE 1

| C | Si | Mn | S | (mass %) Al |
|---|---|---|---|---|
| 0.12 | 1.3 | 2.0 | 0.003 | 0.03 |

The initial dew points at the respective positions in the furnace and the effects in dew point reduction in accordance with the locations of refiner suction are described in Table 2.

TABLE 2

| | | Dew points | | | | | | |
|---|---|---|---|---|---|---|---|---|
| No. | Base conditions | Joint ° C. | Upper portion of soaking zone ° C. | Center of soaking zone ° C. | Lower portion of soaking zone ° C. | Upper portion of heating zone ° C. | Center of heating zone ° C. | Lower portion of heating zone ° C. |
| 1 | A | −35.0 | −33.3 | −35.7 | −36.9 | −34.5 | −35.2 | −35.1 |
| 2 | A | −52.0 | −52.1 | −52.4 | −52.9 | −52.9 | −52.1 | −51.9 |
| 3 | A | −50.1 | −47.3 | −46.2 | −45.9 | −46.1 | −47.2 | −44.6 |
| 4 | A | −50.5 | −47.5 | −46.4 | −45.1 | −45.7 | −48.0 | −43.9 |
| 5 | A | −50.9 | −48.3 | −49.6 | −47.3 | −46.7 | −48.8 | −46.9 |
| 6 | A | −51.2 | −51.6 | −51.3 | −51.2 | −51.0 | −51.3 | −50.9 |
| 7 | A | −52.5 | −48.1 | −47.8 | −48.6 | −50.3 | −48.2 | −48.3 |
| 8 | A | −47.1 | −43.4 | −42.9 | −42.5 | −41.8 | −40.8 | −38.9 |
| 9 | A | −49.7 | −49.1 | −48.7 | −48.4 | −48.1 | −47.8 | −45.3 |
| 10 | B | −35.3 | −34.9 | −32.2 | −36.8 | −35.5 | −35.4 | −35.3 |
| 11 | B | −51.7 | −51.3 | −50.7 | −51.5 | −52.2 | −50.9 | −51.1 |
| 12 | B | −50.3 | −47.9 | −46.3 | −45.2 | −45.8 | −48.1 | −43.6 |
| 13 | B | −50.5 | −47.3 | −46.8 | −45.3 | −45.9 | −47.6 | −43.3 |
| 14 | B | −51.1 | −49.2 | −49.5 | −47.1 | −45.5 | −47.6 | −46.5 |
| 15 | B | −51.4 | −50.7 | −50.9 | −51.0 | −50.9 | −50.3 | −50.3 |
| 16 | B | −52.5 | −46.7 | −47.3 | −48.8 | −49.2 | −48.2 | −48.4 |
| 17 | B | −51.4 | −47.3 | −49.9 | −50.6 | −44.6 | −49.7 | −50.0 |
| 18 | C | −35.5 | −35.2 | −35.9 | −36.2 | −36.1 | −33.7 | −35.4 |
| 19 | C | −51.2 | −51.0 | −50.5 | −50.6 | −51.5 | −50.4 | −50.3 |
| 20 | C | −50.7 | −47.3 | −46.2 | −45.8 | −45.2 | −44.4 | −43.3 |
| 21 | C | −51.2 | −46.4 | −46.4 | −44.8 | −47.0 | −45.6 | −43.9 |
| 22 | C | −51.0 | −49.2 | −49.1 | −47.5 | −49.7 | −47.2 | −47.1 |

TABLE 2-continued

| | | | | | | | | |
|---|---|---|---|---|---|---|---|---|
| 23 | C | −51.4 | −50.3 | −50.4 | −50.3 | −50.6 | −50.3 | −50.1 |
| 24 | C | −52.0 | −46.4 | −46.3 | −49.0 | −48.3 | −47.9 | −48.1 |
| 25 | C | −45.2 | −46.1 | −48.0 | −48.3 | −48.6 | −48.2 | −47.6 |
| 26 | D | −35.7 | −35.3 | −35.1 | −31.7 | −35.9 | −35.6 | −35.8 |
| 27 | D | −51.5 | −51.3 | −50.8 | −51.0 | −51.2 | −50.9 | −50.3 |
| 28 | D | −50.5 | −47.8 | −45.8 | −45.8 | −45.1 | −44.8 | −43.9 |
| 29 | D | −51.3 | −47.8 | −46.8 | −45.4 | −48.3 | −47.6 | −43.4 |
| 30 | D | −50.8 | −49.1 | −49.0 | −47.2 | −50.1 | −48.1 | −47.4 |
| 31 | D | −51.3 | −50.1 | −50.2 | −51.0 | −50.7 | −50.5 | −50.4 |
| 32 | D | −51.9 | −47.1 | −47.2 | −49.6 | −49.1 | −48.5 | −48.9 |

| | Rates of suction at furnace-to-refiner gas suction openings | | | | | | |
|---|---|---|---|---|---|---|---|
| No. | Lower portion of joint $Nm^3/hr$ | Upper portion of soaking zone $Nm^3/hr$ | Center of soaking zone $Nm^3/hr$ | Lower portion of soaking zone $Nm^3/hr$ | Center of heating zone $Nm^3/hr$ | Heating zone*) X = 2 m Y = 5 m $Nm^3/hr$ | Heating zone*) X = 4 m Y = 7 m $Nm^3/hr$ |
| 1 | 0 | 0 | 0 | 0 | 0 | 0 | 0 |
| 2 | 300 | 1200 | 0 | 0 | 0 | 0 | 0 |
| 3 | 300 | 1200 | 0 | 0 | 0 | 0 | 0 |
| 4 | 300 | 1200 | 0 | 0 | 0 | 0 | 0 |
| 5 | 300 | 1200 | 0 | 0 | 0 | 0 | 0 |
| 6 | 300 | 1200 | 0 | 0 | 0 | 0 | 0 |
| 7 | 300 | 0 | 1200 | 0 | 0 | 0 | 0 |
| 8 | 300 | 0 | 0 | 0 | 0 | 1200 | 0 |
| 9 | 300 | 0 | 0 | 0 | 0 | 0 | 1200 |
| 10 | 0 | 0 | 0 | 0 | 0 | 0 | 0 |
| 11 | 300 | 0 | 1200 | 0 | 0 | 0 | 0 |
| 12 | 300 | 0 | 1200 | 0 | 0 | 0 | 0 |
| 13 | 300 | 0 | 1200 | 0 | 0 | 0 | 0 |
| 14 | 300 | 0 | 1200 | 0 | 0 | 0 | 0 |
| 15 | 300 | 0 | 1200 | 0 | 0 | 0 | 0 |
| 16 | 300 | 1200 | 0 | 0 | 0 | 0 | 0 |
| 17 | 300 | 0 | 1200 | 0 | 0 | 0 | 0 |
| 18 | 0 | 0 | 0 | 0 | 0 | 0 | 0 |
| 19 | 300 | 0 | 0 | 0 | 1200 | 0 | 0 |
| 20 | 300 | 0 | 0 | 0 | 1200 | 0 | 0 |
| 21 | 300 | 0 | 0 | 0 | 1200 | 0 | 0 |
| 22 | 300 | 0 | 0 | 0 | 1200 | 0 | 0 |
| 23 | 300 | 0 | 0 | 0 | 1200 | 0 | 0 |
| 24 | 300 | 0 | 0 | 1200 | 0 | 0 | 0 |
| 25 | 300 | 0 | 0 | 0 | 1200 | 0 | 0 |
| 26 | 0 | 0 | 0 | 0 | 0 | 0 | 0 |
| 27 | 300 | 0 | 0 | 1200 | 0 | 0 | 0 |
| 28 | 300 | 0 | 0 | 1200 | 0 | 0 | 0 |
| 29 | 300 | 0 | 0 | 1200 | 0 | 0 | 0 |
| 30 | 300 | 0 | 0 | 1200 | 0 | 0 | 0 |
| 31 | 300 | 0 | 0 | 1200 | 0 | 0 | 0 |
| 32 | 300 | 0 | 0 | 0 | 1200 | 0 | 0 |

| | Rates of ejection at refiner-to- furnace gas ejection openings | | | | | |
|---|---|---|---|---|---|---|
| No. | Joint $Nm^3/hr$ | Upper portion of heating zone - first opening from entrance side $Nm^3/hr$ | Upper portion of heating zone - second opening from entrance side $Nm^3/hr$ | Upper portion of heating zone - third opening from entrance side $Nm^3/hr$ | Upper portion of heating zone - fourth opening from entrance side $Nm^3/hr$ | Remarks |
| 1 | 0 | 0 | 0 | 0 | 0 | Comparative Example (base of A) |
| 2 | 300 | 300 | 300 | 300 | 300 | Inventive Example (optimum A case) |
| 3 | 0 | 1200 | 0 | 0 | 0 | Inventive Example |
| 4 | 0 | 0 | 0 | 0 | 1200 | Inventive Example |
| 5 | 0 | 600 | 600 | 0 | 0 | Inventive Example |
| 6 | 0 | 400 | 400 | 400 | 0 | Inventive Example |
| 7 | 300 | 300 | 300 | 300 | 300 | Inventive Example |
| 8 | 300 | 300 | 300 | 300 | 300 | Comparative Example, Suction openings in the heating zone were disposed outside the inventive range. |
| 9 | 300 | 300 | 300 | 300 | 300 | Inventive Example |
| 10 | 0 | 0 | 0 | 0 | 0 | Comparative Example (base of B) |
| 11 | 300 | 300 | 300 | 300 | 300 | Inventive Example (optimum B case) |

TABLE 2-continued

| | | | | | | |
|---|---|---|---|---|---|---|
| 12 | 0 | 1200 | 0 | 0 | 0 | Inventive Example |
| 13 | 0 | 0 | 0 | 0 | 1200 | Inventive Example |
| 14 | 0 | 600 | 600 | 0 | 0 | Inventive Example |
| 15 | 0 | 400 | 400 | 400 | 0 | Inventive Example |
| 16 | 0 | 400 | 400 | 400 | 0 | Inventive Example |
| 17 | 300 | *300 | *300 | *300 | *300 | Inventive Example, Ejection openings in the heating zone were disposed 4 m below the center of upper hearth rolls. |
| 18 | 0 | 0 | 0 | 0 | 0 | Comparative Example (base of C) |
| 19 | 300 | 300 | 300 | 300 | 300 | Inventive Example (optimum C case) |
| 20 | 0 | 1200 | 0 | 0 | 0 | Inventive Example |
| 21 | 0 | 0 | 0 | 0 | 1200 | Inventive Example |
| 22 | 0 | 600 | 600 | 0 | 0 | Inventive Example |
| 23 | 0 | 400 | 400 | 400 | 0 | Inventive Example |
| 24 | 0 | 400 | 400 | 400 | 0 | Inventive Example |
| 25 | *300 | 300 | 300 | 300 | 300 | Inventive Example, Ejection opening in the joint was disposed 1 m below the pass line. |
| 26 | 0 | 0 | 0 | 0 | 0 | Comparative Example (base of D) |
| 27 | 300 | 300 | 300 | 300 | 300 | Inventive Example (optimum D case) |
| 28 | 0 | 1200 | 0 | 0 | 0 | Inventive Example |
| 29 | 0 | 0 | 0 | 0 | 1200 | Inventive Example |
| 30 | 0 | 600 | 600 | 0 | 0 | Inventive Example |
| 31 | 0 | 400 | 400 | 400 | 0 | Inventive Example |
| 32 | 0 | 400 | 400 | 400 | 0 | Inventive Example |

*X and Y represent locations of suction openings. X indicates the distance (m) from the steel strip inlet in the furnace length direction. Y indicates the distance from the steel strip inlet in the vertical direction.

The base conditions were divided into four groups A to D by the locations where the highest dew point was measured in the furnace except in the lower portion of the heating zone. In Inventive Examples, a dew point of −40° C. or below was obtained under all the base conditions. In Inventive Examples, a particularly low dew point was obtained when the gas was ejected from the refiner to the inside of the heating zone over a gas ejection width that was larger than ¼ of the furnace width of the heating zone plus the soaking zone, or when the gas was ejected to the joint between the soaking zone and the cooling zone. A low dew point of −50° C. or below was obtained when the gas was suctioned to the refiner preferentially from a location where a higher dew point had been measured and also when the gas was ejected from the refiner to the inside of the heating zone over a gas ejection width that was ¼ or more of the furnace width of the heating zone plus the soaking zone.

EXAMPLE 2

Trends of dew point decrease were studied with the ART type (all radiant type) CGL illustrated in FIG. 1 which was used in EXAMPLE 1.

The conditions in a conventional method (without the use of the refiner) were such that the atmosphere gas supplied into the furnace had a composition including 8 vol % $H_2$ and the balance of $N_2$ and inevitable impurities (dew point −60° C.), the rate of gas supply to the cooling zone and subsequent zones was 300 $Nm^3$/hr, the rate of gas supply to the soaking zone was 100 $Nm^3$/hr, the rate of gas supply to the heating zone was 450 $Nm^3$/hr, the steel strips had a sheet thickness of 0.8 to 1.2 mm and a sheet width of 950 to 1000 mm (the alloy components in the steel were the same as in Table 1), the annealing temperature was 800° C., and the line speed was 100 to 120 mpm.

Figure 4:
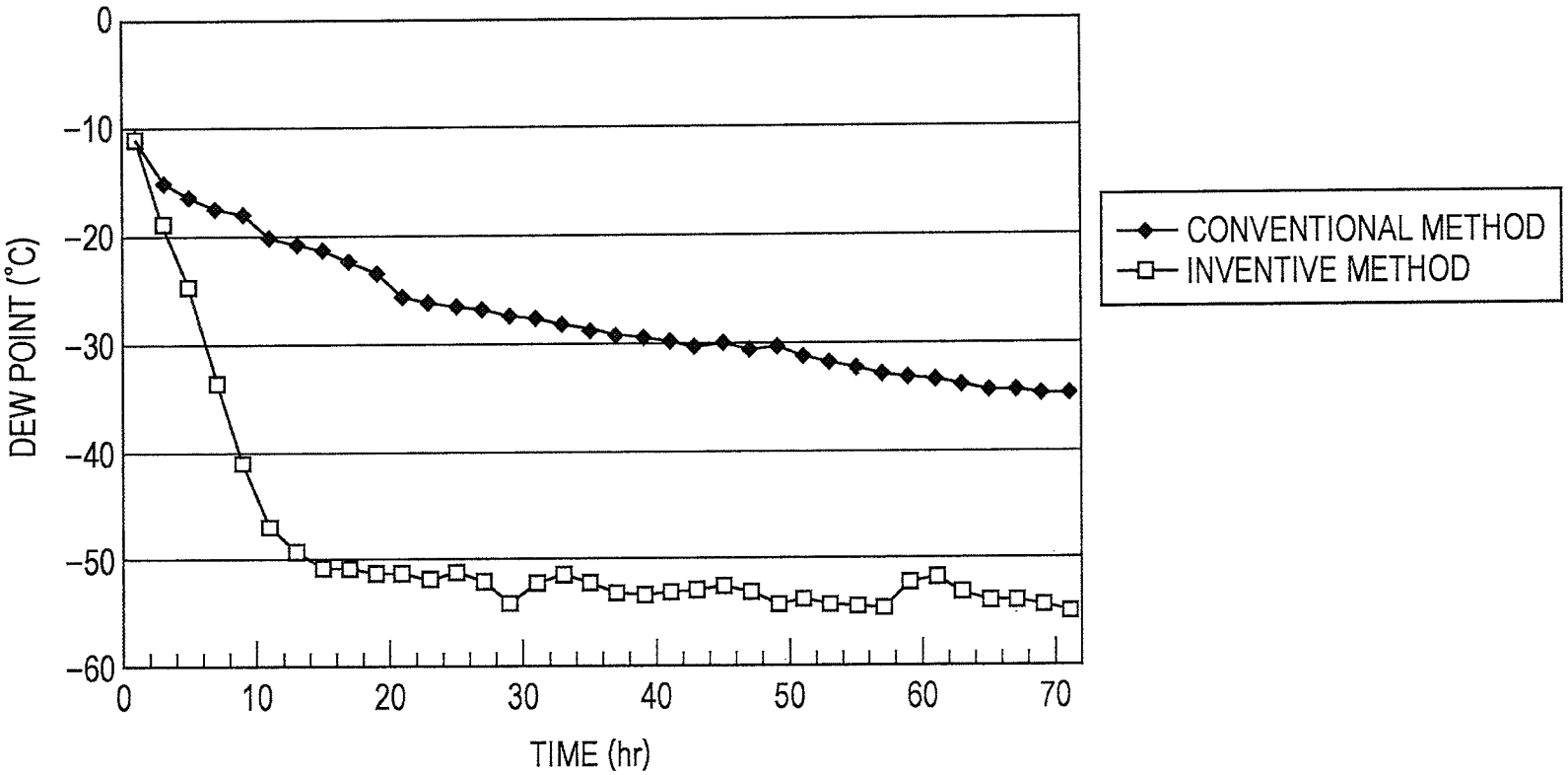
FIG. 4 is a diagram illustrating trends of dew point decrease in an annealing furnace.

The conditions in the inventive method were the same as the above conditions and further included the use of the refiner. The initial state of dew point was similar to the base conditions A in EXAMPLE 1 (in which the dew point was highest at the upper portion of the soaking zone). Based on this, the suction performing locations and other configurations were determined in accordance with the conditions of No. 2 (optimum conditions A) in EXAMPLE 1 shown in Table 2. The results of the study are described in FIG. 4. The dew point data indicate the dew point at the upper portion of the soaking zone.

In the conventional method, it took approximately 40 hours to decrease the dew point to −30° C. or below, and the dew point remained above −35° C. even after 70 hours. In contrast, the inventive method was able to decrease the dew point to −30° C. or below in 6 hours, to −40° C. or below in 9 hours, and to −50° C. or below in 14 hours.

Prior to the steady operation of continuous heat treatment of a steel strip or when the water concentration and/or the oxygen concentration in the furnace atmosphere has increased during the steady operation, the continuous annealing furnace for steel strips according to the present invention can quickly decrease the water concentration and/or the oxygen concentration in the furnace atmosphere to such a level where the dew point of the furnace atmosphere is lowered to −30° C. or below at which stable production of steel strips is feasible.

With use of the continuous annealing furnace for steel strips according to the present invention, a high-strength steel strip containing easily oxidizable elements such as silicon and manganese can be continuously annealed in a way that reduces the problematic occurrence of pick-up defects and damages to furnace walls without any partition wall between the soaking zone and the heating zone.

REFERENCE SIGNS LIST

1 STEEL STRIP
2 ANNEALING FURNACE
3 HEATING ZONE
4 SOAKING ZONE
5 COOLING ZONE
5*a* FIRST COOLING ZONE
5*b* SECOND COOLING ZONE
6 SNOUT
7 COATING BATH
8 GAS WIPING NOZZLES
9 HEATING DEVICE
10 REFINER
11*a* UPPER HEARTH ROLL
11*b* LOWER HEARTH ROLL
12 SEAL ROLLS
13 JOINT
14 THROAT
15 ATMOSPHERE GAS SUPPLY SYSTEM
16 FURNACE-TO-REFINER GAS INTRODUCTION PIPE
17 REFINER-TO-FURNACE GAS DELIVERY PIPE
22*a* to 22*e* FURNACE-TO-REFINER GAS SUCTION OPENINGS
23*a* to 23*e* REFINER-TO-FURNACE GAS EJECTION OPENINGS
24, 25 DEW POINT DETECTION UNITS
30 HEAT EXCHANGER
31 COOLER
32 FILTER
33 BLOWER
34 OXYGEN REMOVAL DEVICE
35, 36 DEHUMIDIFIERS
46, 51 SELECTOR VALVES
40 to 45, 47 to 50, 52, 53 VALVES

The invention claimed is:

1. A continuous annealing furnace for a steel strip comprising a heating zone, a soaking zone and a cooling zone disposed in this order and configured to transport the steel strip in upward and/or downward directions, a joint connecting the soaking zone and the cooling zone being disposed at an upper portion of the furnace, the heating zone and the soaking zone having no partition wall therebetween, the furnace being a vertical annealing furnace and being configured such that an atmosphere gas is supplied from outside the furnace into the furnace, the gas in the furnace is discharged through a steel strip inlet at a lower portion of the heating zone while part of the gas in the furnace is suctioned and introduced into a refiner equipped with an oxygen removal device and a dehumidifier to lower the dew point by the removal of oxygen and water in the gas, the refiner being disposed outside the furnace, and the gas with the lowered dew point is returned into the furnace, the furnace having gas suction openings disposed in a lower portion of the joint between the soaking zone and the cooling zone and at least one of in the heating zone and the soaking zone, the heating zone being free from any gas suction openings in a region extending 6 m in a vertical direction and 3 m in a furnace length direction both from the steel strip inlet at a lower portion of the heating zone, the furnace having gas ejection openings disposed in a region in the joint between the soaking zone and the cooling zone, the region being located above a pass line in the joint, and in a region in the heating zone, the region being located above a position 2 m below the center of upper hearth rolls in the vertical direction.

2. The continuous annealing furnace for a steel strip according to claim 1, wherein the gas ejection openings in the heating zone have an ejection width W0 satisfying W0/W >¼ wherein W is the furnace width of the heating zone plus the soaking zone, the ejection width W0 of the gas ejection openings being defined as the distance in the furnace length direction between the most upstream gas ejection opening and the most downstream gas ejection opening in the heating zone.

3. The continuous annealing furnace for a steel strip according to claim 1, wherein the gas suction opening disposed in the lower portion of the joint between the soaking zone and the cooling zone is disposed in a choked gas flow channel in the lower portion of the joint between the soaking zone and the cooling zone.

4. The continuous annealing furnace for a steel strip according to claim 1, wherein the gas suction openings are disposed in a plurality of positions in the heating zone and/or the soaking zone, and the furnace has dew point detection units of dew point meters disposed in the vicinity of the gas suction openings in the plurality of positions, the dew point detection units being configured to detect the dew points of the gas in the furnace.

5. The continuous annealing furnace for a steel strip according to claim 1, wherein the cooling zone is configured to transport the steel strip therethrough in a single pass.

6. The continuous annealing furnace for a steel strip according to claim 1, wherein the furnace includes a hot dip galvanization facility downstream from the annealing furnace.

7. The continuous annealing furnace for a steel strip according to claim 6, wherein the hot dip galvanization facility includes a galvannealing apparatus.

8. A continuous annealing method for a steel strip, characterized by continuously annealing a steel strip with the continuous annealing furnace for a steel strip described in claim 4 in such a manner that the dew point of a gas in the furnace is measured with the dew point meters disposed at the heating zone and/or the soaking zone, and the gas in the furnace is suctioned preferentially through the gas suction opening disposed in a position where a higher value of dew point has been measured.

9. The continuous annealing furnace for a steel strip according to claim 2, wherein the gas suction opening disposed in the lower portion of the joint between the soaking zone and the cooling zone is disposed in a choked gas flow channel in the lower portion of the joint between the soaking zone and the cooling zone.

10. The continuous annealing furnace for a steel strip according to claim 2, wherein the gas suction openings are disposed in a plurality of positions in the heating zone and/or the soaking zone, and the furnace has dew point detection units of dew point meters disposed in the vicinity of the gas suction openings in the plurality of positions, the dew point detection units being configured to detect the dew points of the gas in the furnace.

11. The continuous annealing furnace for a steel strip according to claim 3, wherein the gas suction openings are disposed in a plurality of positions in the heating zone and/or the soaking zone, and the furnace has dew point detection units of dew point meters disposed in the vicinity of the gas suction openings in the plurality of positions, the dew point detection units being configured to detect the dew points of the gas in the furnace.

12. The continuous annealing furnace for a steel strip according to claim 9, wherein the gas suction openings are disposed in a plurality of positions in the heating zone and/or the soaking zone, and the furnace has dew point detection units of dew point meters disposed in the vicinity of the gas suction openings in the plurality of positions, the dew point detection units being configured to detect the dew points of the gas in the furnace.

13. The continuous annealing furnace for a steel strip according to claim 2, wherein the cooling zone is configured to transport the steel strip therethrough in a single pass.

14. The continuous annealing furnace for a steel strip according to claim 3, wherein the cooling zone is configured to transport the steel strip therethrough in a single pass.

15. The continuous annealing furnace for a steel strip according to claim 4, wherein the cooling zone is configured to transport the steel strip therethrough in a single pass.

16. The continuous annealing furnace for a steel strip according to claim 9, wherein the cooling zone is configured to transport the steel strip therethrough in a single pass.

17. The continuous annealing furnace for a steel strip according to claim 10, wherein the cooling zone is configured to transport the steel strip therethrough in a single pass.

18. The continuous annealing furnace for a steel strip according to claim 11, wherein the cooling zone is configured to transport the steel strip therethrough in a single pass.

19. The continuous annealing furnace for a steel strip according to claim 12, wherein the cooling zone is configured to transport the steel strip therethrough in a single pass.

20. The continuous annealing furnace for a steel strip according to claim 2, wherein the furnace includes a hot dip galvanization facility downstream from the annealing furnace.

21. The continuous annealing furnace for a steel strip according to claim 3, wherein the furnace includes a hot dip galvanization facility downstream from the annealing furnace.

22. The continuous annealing furnace for a steel strip according to claim 4, wherein the furnace includes a hot dip galvanization facility downstream from the annealing furnace.

23. The continuous annealing furnace for a steel strip according to claim 5, wherein the furnace includes a hot dip galvanization facility downstream from the annealing furnace.

24. The continuous annealing furnace for a steel strip according to claim 9, wherein the furnace includes a hot dip galvanization facility downstream from the annealing furnace.

25. The continuous annealing furnace for a steel strip according to claim 10, wherein the furnace includes a hot dip galvanization facility downstream from the annealing furnace.

26. The continuous annealing furnace for a steel strip according to claim 11, wherein the furnace includes a hot dip galvanization facility downstream from the annealing furnace.

27. The continuous annealing furnace for a steel strip according to claim 12, wherein the furnace includes a hot dip galvanization facility downstream from the annealing furnace.

28. The continuous annealing furnace for a steel strip according to claim 13, wherein the furnace includes a hot dip galvanization facility downstream from the annealing furnace.

29. The continuous annealing furnace for a steel strip according to claim 14, wherein the furnace includes a hot dip galvanization facility downstream from the annealing furnace.

30. The continuous annealing furnace for a steel strip according to claim 15, wherein the furnace includes a hot dip galvanization facility downstream from the annealing furnace.

31. The continuous annealing furnace for a steel strip according to claim 16, wherein the furnace includes a hot dip galvanization facility downstream from the annealing furnace.

32. The continuous annealing furnace for a steel strip according to claim 17, wherein the furnace includes a hot dip galvanization facility downstream from the annealing furnace.

33. The continuous annealing furnace for a steel strip according to claim 18, wherein the furnace includes a hot dip galvanization facility downstream from the annealing furnace.

34. The continuous annealing furnace for a steel strip according to claim 19, wherein the furnace includes a hot dip galvanization facility downstream from the annealing furnace.

35. A continuous annealing method for a steel strip, characterized by continuously annealing a steel strip with the continuous annealing furnace for a steel strip described in claim 10 in such a manner that the dew point of a gas in the furnace is measured with the dew point meters disposed at the heating zone and/or the soaking zone, and the gas in the furnace is suctioned preferentially through the gas suction opening disposed in a position where a higher value of dew point has been measured.

36. A continuous annealing method for a steel strip, characterized by continuously annealing a steel strip with the continuous annealing furnace for a steel strip described in claim 11 in such a manner that the dew point of a gas in the furnace is measured with the dew point meters disposed at the heating zone and/or the soaking zone, and the gas in the furnace is suctioned preferentially through the gas suction opening disposed in a position where a higher value of dew point has been measured.

37. A continuous annealing method for a steel strip, characterized by continuously annealing a steel strip with the continuous annealing furnace for a steel strip described in claim 12 in such a manner that the dew point of a gas in the furnace is measured with the dew point meters disposed at the heating zone and/or the soaking zone, and the gas in the furnace is suctioned preferentially through the gas suction opening disposed in a position where a higher value of dew point has been measured.

* * * * *